US011084618B2

(12) United States Patent
Bourne

(10) Patent No.: US 11,084,618 B2
(45) Date of Patent: Aug. 10, 2021

(54) PACKAGING AND BLANK THEREFOR

(71) Applicant: MAYR-MELNHOF KARTON AG, Vienna (AT)

(72) Inventor: Timothy John Bourne, Northumberland (GB)

(73) Assignee: MAYR-MELNHOF KARTON AG, Vienna (AT)

( * ) Notice: Subject to any disclaimer, the term of this patent is extended or adjusted under 35 U.S.C. 154(b) by 0 days.

(21) Appl. No.: 16/608,899

(22) PCT Filed: Apr. 28, 2017

(86) PCT No.: PCT/EP2017/060249

§ 371 (c)(1),
(2) Date: Oct. 28, 2019

(87) PCT Pub. No.: WO2018/197013

PCT Pub. Date: Nov. 1, 2018

(65) Prior Publication Data

US 2020/0087018 A1 Mar. 19, 2020

(51) Int. Cl.

*B65D 5/02* (2006.01)
*B65D 5/10* (2006.01)
*B65D 5/54* (2006.01)

(52) U.S. Cl.

CPC ..... *B65D 5/029* (2013.01); *B65D 5/10* (2013.01); *B65D 5/5425* (2013.01); *B65D 2517/0013* (2013.01)

(58) Field of Classification Search

CPC ..... B65D 5/029; B65D 5/10; B65D 5/5425; B65D 5/443; B65D 5/4279; B31B 50/28; B31B 50/282

(Continued)

(56) References Cited

U.S. PATENT DOCUMENTS 5,147,271 A 9/1992 Bacques et al.
5,292,059 A 3/1994 Oliff (Continued)

FOREIGN PATENT DOCUMENTS

CL 32394 4/1997
CL 43358 5/1999

(Continued)

OTHER PUBLICATIONS

International Search Report dated Jan. 16, 2018 in corresponding International Patent Application No. PCT/EP2017/060249.

(Continued)

*Primary Examiner* — Christopher R Demeree
(74) *Attorney, Agent, or Firm* — Medler Ferro Woodhouse & Mills PLLC

(57) ABSTRACT

A packaging is disclosed that is made from cardboard, paper or similar, and includes a base wall and a cover wall, respectively at least one front wall and one rear wall connecting the base wall and the cover wall in order to form lateral sides of the packaging. The packaging is designed as a prismatic body along a longitudinal axis extending parallel to the base wall and cover wall, and at least one dust flap coupled to one end of at least one front wall or rear wall). The dust flap is designed in such a way that, in a closed position, it rests at least in regions on one of the front and rear walls to which it is not coupled, and/or on the base wall and/or the cover wall and protrudes at least regionally over these. The disclosure also relates to a blank for producing such a packaging.

15 Claims, 4 Drawing Sheets

(58) Field of Classification Search
USPC ..... 229/108, 109, 190, 141, 918; 206/509, 206/521, 586
See application file for complete search history.

(56) References Cited

U.S. PATENT DOCUMENTS

| | | | | |
|---|---|---|---|---|
| 6,273,330 | B1 | 8/2001 | Oliff et al. | |
| 6,315,123 | B1 | 11/2001 | Ikeda | |
| 7,350,670 | B2 * | 4/2008 | Steeves | B65D 77/065 222/105 |
| 7,717,838 | B2 * | 5/2010 | Strong | B65D 5/722 493/175 |
| 7,857,743 | B2 * | 12/2010 | Barner | B65D 5/48024 493/175 |
| 7,935,041 | B2 * | 5/2011 | Graham | B65D 5/566 493/98 |
| 8,011,564 | B2 * | 9/2011 | Garner | B65D 71/36 229/110 |
| 8,800,854 | B2 * | 8/2014 | Chapman | B65D 5/48042 229/199 |
| 9,022,913 | B2 * | 5/2015 | Graham | B65D 5/0227 493/51 |
| 9,114,921 | B2 * | 8/2015 | Smith | B65D 5/0227 |
| 9,409,367 | B2 * | 8/2016 | Graham | B31B 50/00 |
| 9,701,087 | B2 * | 7/2017 | Graham | B31B 50/00 |
| 9,701,088 | B2 * | 7/2017 | Strong | B65D 5/029 |
| 9,919,830 | B2 * | 3/2018 | Smith | B65D 5/443 |
| 10,189,623 | B2 * | 1/2019 | Voelker | B65D 25/2894 |
| 10,265,919 | B2 * | 4/2019 | Graham | B31B 50/00 |
| 2008/0203142 | A1 | 8/2008 | Grossman et al. | |
| 2010/0219232 | A1 | 9/2010 | Smith | |
| 2011/0111938 | A1 | 5/2011 | Smith | |

FOREIGN PATENT DOCUMENTS

| | | | |
|---|---|---|---|
| CL | 44881 | | 8/2002 |
| DE | 20 2004 011 165 | U1 | 12/2005 |
| EP | 0 468 860 | A1 | 1/1992 |
| JP | 2015030246 | A | 2/2015 |
| WO | 2015/010726 | A1 | 1/2015 |
| WO | 2015/011186 | A1 | 1/2015 |

OTHER PUBLICATIONS

Chilean Office Action dated Dec. 16, 2020 in corresponding Chilean Application No. PCT/2019-003068.
Office Action issued for Japanese Application No. 2019-557477, issued by the Japan Patent Office dated May 18, 2021 (with English translation).

* cited by examiner

PACKAGING AND BLANK THEREFOR

The present invention relates to a packaging made of cardboard, paper or the like, comprising a base wall and a top wall, at least a respective front wall and rear wall, which connect the base wall and top wall and are intended for forming end sides of the packaging, wherein the packaging is designed in the form of a prismatic body along a longitudinal axis running parallel to the base wall and top wall, and also comprising at least one dust flap, which is articulated at one end at least of a front wall and rear wall. The invention also relates to a blank for producing such a pack.

A large number of such packagings are known. In particular, such packagings are used for receiving, transporting and storing packaged or non-packaged free-flowing goods. The goods can be, for example, cereals, cornflakes or other pourable and free-flowing foods, or also washing powder and the like. However, it is also possible to store liquids, in appropriately liquid-tight intermediate packagings, in the aforementioned packagings. DE 20 2004 011 165 U1 discloses a powder-tight pack for pulverulent goods. The known pack here is designed in the form of a prismatic, octagonal body. The disadvantage with such prismatic-design packs, however, is that a plurality of dust flaps have to be formed, in addition to the top flaps, for the purpose of sealing the top structure and/or base structure. In particular the corner regions of the top structure and/or base structure are exposed, in addition, to instability when subjected to compressive loading, for example when said packagings are stored or stacked one above the other. This can result in undesirable damage to the packaging. US 2011/111938 A1 and EP 0 468 860 A1 disclose comparable cardboard packagings and corresponding blanks. It is also the case that WO 2015/010726 A1 discloses similar packagings and blanks. However, the packagings disclosed here, as is also the case with the prior-art packagings described above, are "upright" prismatic bodies formed along a longitudinal axis, wherein the longitudinal axis runs parallel to a longitudinal extent of the front wall, rear wall and side walls. The longitudinal axis is therefore arranged perpendicularly to a base surface or top surface.

In the case of packagings of the type in question which are designed in the form of a "horizontally lying" prismatic body along a longitudinal axis running parallel to the base wall and top wall, the larger bearing surface area of the base wall and top wall and the "horizontally lying" stacking arrangement, for example in a sales rack, give rise to less compressive loading in the regions of the corresponding base structure and top structure. However, such packagings are protected only to an insufficient extent against loading of the side walls, in particular during storage or transportation of the packagings in the "upright" state, i.e. when the prismatic bodies are being stored with the longitudinal axis in an upright, vertically erected position.

It is therefore the object of the present invention to provide a packaging of the type in question and also a blank therefor which, alongside secure closure and reliable covering in the region of the side walls of the packaging, ensure increased loading stability of the packaging in said regions, in particular during "upright" storage or transportation of the packaging with the longitudinal axes in an upright, vertically erected position.

These objects are achieved by a packaging of the type in question according to the features of claim 1 and by a blank according to the features of claim 10. Advantageous configurations with expedient developments of the invention are specified in the respective dependent claims, wherein advantageous configurations of the packaging can be considered to be advantageous configurations of the blank, and vice versa.

A packaging according to the invention made of cardboard, paper or the like comprises a base wall and a top wall, at least a respective front wall and rear wall, which connect the base wall and top wall and are intended for forming end sides of the packaging, wherein the packaging is designed in the form of a prismatic body along a longitudinal axis running parallel to the base wall and top wall, and also comprises at least one dust flap, which is articulated at one end at least of a front wall and rear wall. As an option, at least a respective side flap, which is articulated on the base wall and/or the top wall, can be formed for the purpose of closing the pack laterally. The dust flap here is designed such that, in a closed position, it rests, at least in part, at least on one of the, or on the, front and rear walls on which it is not articulated and/or on the base wall and/or top wall, and projects beyond the same at least in part. The configuration of the dust flap according to the invention ensures secure closure and reliable covering of those regions of the packaging which include the front wall and/or rear wall and/or the corresponding side walls or flaps. Furthermore, the fact that the dust flap rests, at least in part, on the front wall and/or rear wall and/or the base wall and/or top wall of the packaging results in increased loading stability of the pack in said regions. Such packagings can therefore readily be stacked one beside the other with the longitudinal axes of their prismatic bodies in an upright, vertically erected position, which is necessary, and advantageous, for example for dispatch on pallets. Furthermore, it is possible to use thicknesses of cardboard which are thinner, if appropriate, than in the case of previously known packagings. This reduction in the amount of material used means that the pack according to the invention involves considerable cost-related advantages. The fact that the dust flap projects, at least in part, beyond the front wall and/or rear wall and also the corresponding dimensioning of the dust flap ensure that a front end side and/or rear end side of the packaging is reliably covered over. Even possible compressive loading of said regions when the packaging according to the invention is stored in an upright position does not result in the dust flap being displaced from its resting place on the front wall and/or rear wall and/or the base wall and/or top wall. "Resting on the front wall and/or rear wall and/or the base wall and/or top wall" is also understood to mean that the dust flap does not rest directly on a respective edge of the front wall and/or rear wall and/or of the base wall and/or top wall. It is thus also possible for the dust flap to rest, at least in part, on a packaging element which is articulated on the respective front wall and/or rear wall, for example on a further dust flap. The critical factor is that the dust flap projects beyond the corresponding front wall and/or rear wall and/or the base wall and/or top wall.

In further advantageous configurations of the packaging according to the invention, the dust flap comprises at least one latching nose, wherein the latching nose is designed such that, in the closed position of the dust flap, it butts against the front and rear walls and/or the base wall and/or the top wall. Provision can be made here for the latching nose to latch in at least one recess or opening formed in the side flap. In addition, it is possible for said recess or opening to be formed in the transition region between the base wall and/or top wall and the corresponding side flap. The formation of at least one latching nose which, in the closed position of the dust flap, butts against the corresponding regions of the front and rear walls and/or of the base wall and/or of the top wall of the packaging ensures that the packaging maintains its shape. In particular, this is important when the packaging is erected, and filled, automatically and mechanically. Straightforward and reliable mechanical filling with, in particular, pourable, pulverulent and/or free-flowing foods is ensured only for dimensionally stable packaging. The dimensional stability of the packaging is increased, in addition, by the formation of the aforementioned recess or opening for the latching of the latching nose.

In further advantageous configurations of the packaging, the dust flap comprises at least a first portion, wherein the first portion is articulated on the corresponding front wall and/or rear wall and is designed such that, in the closed position of the dust flap, it covers over that region of a cross-sectional surface of the prismatic-body-design packaging which is formed by the front and/or rear walls, which are arranged on the end sides and/or at the rear, wherein the cross-sectional surface is formed perpendicularly to the longitudinal axis. This ensures that, irrespective of the surface area of the bottom of the prismatic-design packaging, the surfaces formed by the front and/or rear walls are reliably covered over, and closed, by the first portion of the dust flap. It is possible here for the dust flap to have at least a second portion, which adjoins the first portion, wherein the second portion is designed such that, in the closed position of the dust flap, it butts against the inner sides of the base wall and top wall. The abutment of the second portion against the inner sides of the base wall and top wall results in the distance between said elements of the packaging being clearly defined. The inner sides of the base wall and top wall are supported against the second portion of the dust flap. This contributes to the increased dimensional stability of the packaging according to the invention.

In further advantageous configurations of the packaging according to the invention, the latching nose is formed in the first portion and/or the second portion or in each case at least one latching nose is formed in the first portion and/or the second portion. Depending on the configuration of the packaging according to the invention, it is advantageously possible to arrange a predefined number of latching noses in different regions of the dust flap. This allows different stability-related requirements of different shapes of packaging to be met straightforwardly in terms of design.

In a further advantageous configuration of the packaging according to the invention, at least one tear-open flap is formed within the top wall. As a result, the packaging can be readily opened.

In further advantageous configurations of the packaging according to the invention, a cross-sectional surface is of polygonal design, in particular quadrilateral, pentagonal, hexagonal, heptagonal, octagonal, nonagonal, decagonal or dodecagonal design, in a direction perpendicular to the longitudinal axis of the packaging of the prismatic-body-design packaging. However, other shapes, for example round shapes or combinations of round and polygonal shapes, are also possible. In addition, it has surprisingly been found that the packagings according to the invention make it possible for the amount of material, in particular cardboard material, used to be reduced considerably during the production of said packagings. Depending on the number of corners of the cross-sectional surface, it is possible for the amount of material used to be reduced by between 9% and 14%, with the volume remaining constant in relation to a conventional packaging. This gives rise to the amount of material used being reduced, in the case of a generally pentagonal configuration of the cross-sectional surface, by approximately 9% and, in the case of octagonal packagings, by approximately 14%.

It is also possible for the cross-sectional surface to be of triangular design in a direction perpendicular to the longitudinal axis of the packaging. This embodiment can have independent inventive content. In order to form the triangular shape of the packaging, either the front wall or the rear wall is connected to the base wall and top wall, wherein the base wall and top wall, in turn, are connected directly to one another. At least one dust flap, which is articulated on the front wall or rear wall, is designed here such that, in a closed position, it rests, at least in part, at least on one of the front and rear walls, and projects beyond the same at least in part. The configuration of the dust flap according to the invention ensures secure closure and reliable covering of those regions of the packaging which include the front wall and/or rear wall and/or the corresponding side walls or flaps. Furthermore, the fact that the dust flap rests, at least in part, on the front wall and/or rear wall of the packaging results in increased loading stability of the packaging in said regions. Such packagings can therefore readily be stacked one beside the other with the longitudinal axes of their prismatic bodies in an upright, vertically erected position, which is necessary, and advantageous, for example for dispatch on pallets.

A further aspect of the invention relates to a blank for producing a packaging made of cardboard, paper or the like, comprising base-wall, top-wall, front-wall and rear-wall elements, which are connected via folding lines and are intended for forming the packaging in the form of a prismatic body in the folded state of the blank. The blank here comprises at least one dust flap, which is articulated at at least one end of a front-wall and/or rear-wall element. According to the invention, the dust flap is designed such that, in the folded state of the blank and in a closed position, it rests, at least in part, at least on one of the, or the, front-wall and rear-wall elements on which it is not articulated and/or on the base-wall and/or the top-wall element, and projects beyond the same at least in part. As an option, at least a respective side flap, which is articulated on the base-wall and/or the top-wall element, can be formed for the purpose of closing the packaging laterally. A blank which is formed in this way ensures that a packaging produced therefrom is securely closed and reliably covered in those regions of the packaging which include the front-wall and/or rear-wall elements and/or the corresponding side-wall elements or flaps. In addition, the blank according to the invention results in the packaging produced therefrom having increased loading stability in said regions. The configuration of the dust flap according to the invention, in turn, ensures that the packaging produced from the blank is reliably covered by means of the dust flap and, in addition, has a considerably higher dimensional stability than comparable known packagings.

In further advantageous configurations of the blank according to the invention, the dust flap comprises at least one latching nose, wherein the latching nose is designed such that, in the closed position of the dust flap in the folded state of the blank, it butts against the front-wall and rear-wall elements and/or the base-wall element and/or the top-wall element. Provision can be made here so that, in the folded state of the blank, the latching nose latches in at least one recess or opening formed in the side flap. In addition, said recess or opening can be formed in the transition region between the base-wall and/or top-wall element and the corresponding side flap. The formation of at least one latching nose which, in the closed position of the dust flap in the folded state of the blank, butts against the corresponding regions of the front and rear walls and/or of the base wall and/or of the top wall of the packaging ensures that the packaging maintains its shape. In particular, this is important when the packaging is erected, and filled, automatically and mechanically. Straightforward and reliable mechanical filling with, in particular, pourable, pulverulent and/or free-flowing foods or detergents is ensured only for dimensionally stable packagings. The dimensional stability of the folded packaging is increased, in addition, by the formation of the aforementioned recess or opening for the latching of the latching nose.

In further advantageous configurations of the blank according to the invention, the dust flap comprises at least a first portion, wherein the first portion is articulated on the corresponding front-wall and/or rear-wall element and is designed such that, in the folded state of the blank and in the closed position of the dust flap, it covers over that region of the cross-sectional surface of the prismatic-body-design, folded packaging which is formed by the front-wall and/or rear-wall elements, which are arranged on the end sides and/or at the rear, wherein the cross-sectional surface is formed perpendicularly to the longitudinal axis of the folded packaging. This ensures that, irrespective of the surface area of the bottom of the folded, prismatic-design packaging, the surfaces formed by the front-wall and/or rear-wall elements are reliably covered over, and closed, by the first portion of the dust flap. It is possible here for the dust flap to have at least a second portion, which adjoins the first portion, wherein the second portion is designed such that, in the closed position of the dust flap and in the folded state of the blank, it butts against the inner sides of the base-wall and top-wall element. The abutment of the second portion against the inner sides of the base-wall and top-wall element results in the distance between said elements of the folded packaging being clearly defined. The inner sides of the base-wall and top-wall elements here are supported against the second portion of the dust flap. This contributes to the increased dimensional stability of the packaging produced from the blank according to the invention.

In further advantageous configurations of the blank according to the invention, the latching nose is formed in the first portion and/or the second portion or in each case at least one latching nose is formed in the first portion and/or the second portion. Depending on the required configuration of the packaging produced from the blank according to the invention, it is advantageously possible to arrange a predefined number of latching noses in different regions of the dust flap. This allows different stability-related requirements of different shapes of packaging to be met straightforwardly in terms of design.

Further features of the invention can be gathered from the claims, from the exemplary embodiments and with reference to the drawings. The features and combinations of features mentioned above in the description, and also the features and combinations of features mentioned hereinbelow in relation to the exemplary embodiments, can be used not only in the combination specified in each case, but also in other combinations, without there being any departure from the framework of the invention. In the drawings:

Figure 1:
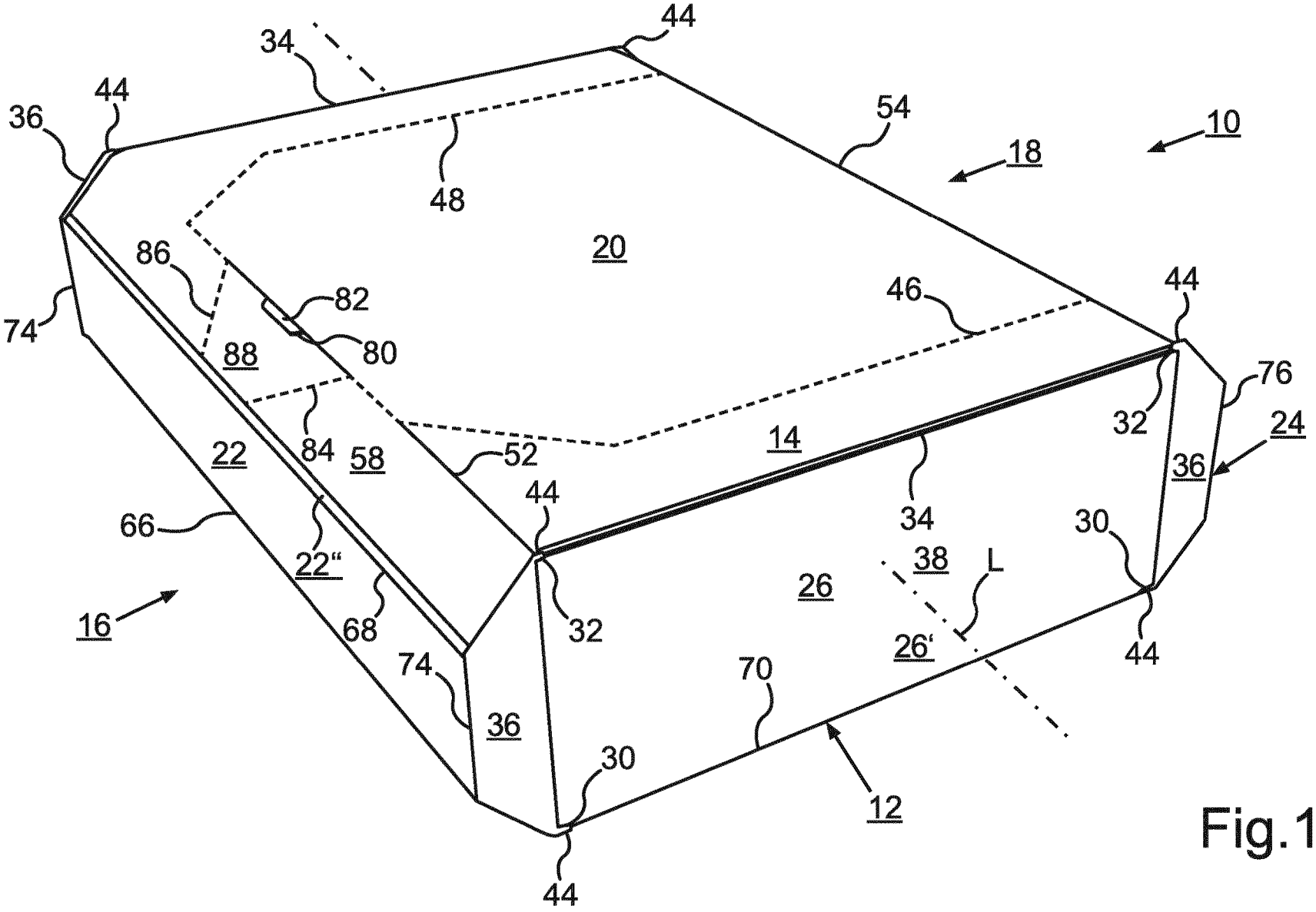
FIG. 1 shows a schematic illustration of a packaging according to the invention.

FIG. 1 shows a schematic illustration of a packaging 10, which serves in particular for storing and transporting packaged or non-packaged free-flowing goods. The goods can be, for example, cereals, cornflakes or other pourable and free-flowing foods, or also washing powder and the like. However, it is also possible to store liquids, in appropriately liquid-tight intermediate packagings, in the packaging 10. The packaging 10 here has a base wall 12 and a top wall 14, which are connected via in each case three connecting front and rear walls 22, 22', 22", 24, 24', 24". The front and rear walls 22, 22', 22", 24, 24', 24" here form a front end side 16 and a rear end side 18 of the packaging 10. It can be seen that the packaging 10 is designed in the form of a prismatic body along a longitudinal axis L running parallel to the base wall and top wall 12, 14 and to the front wall and rear wall 22, 24. The cross-sectional surface 38 of the packaging 10 is of octagonal design in a direction perpendicular to said longitudinal axis. The longitudinal axis L therefore runs parallel to a bearing surface of the packaging 10. In the case of the prior-art packagings mentioned in the introduction, the respective longitudinal axes run perpendicularly to the corresponding bearing surfaces.

Figure 2:
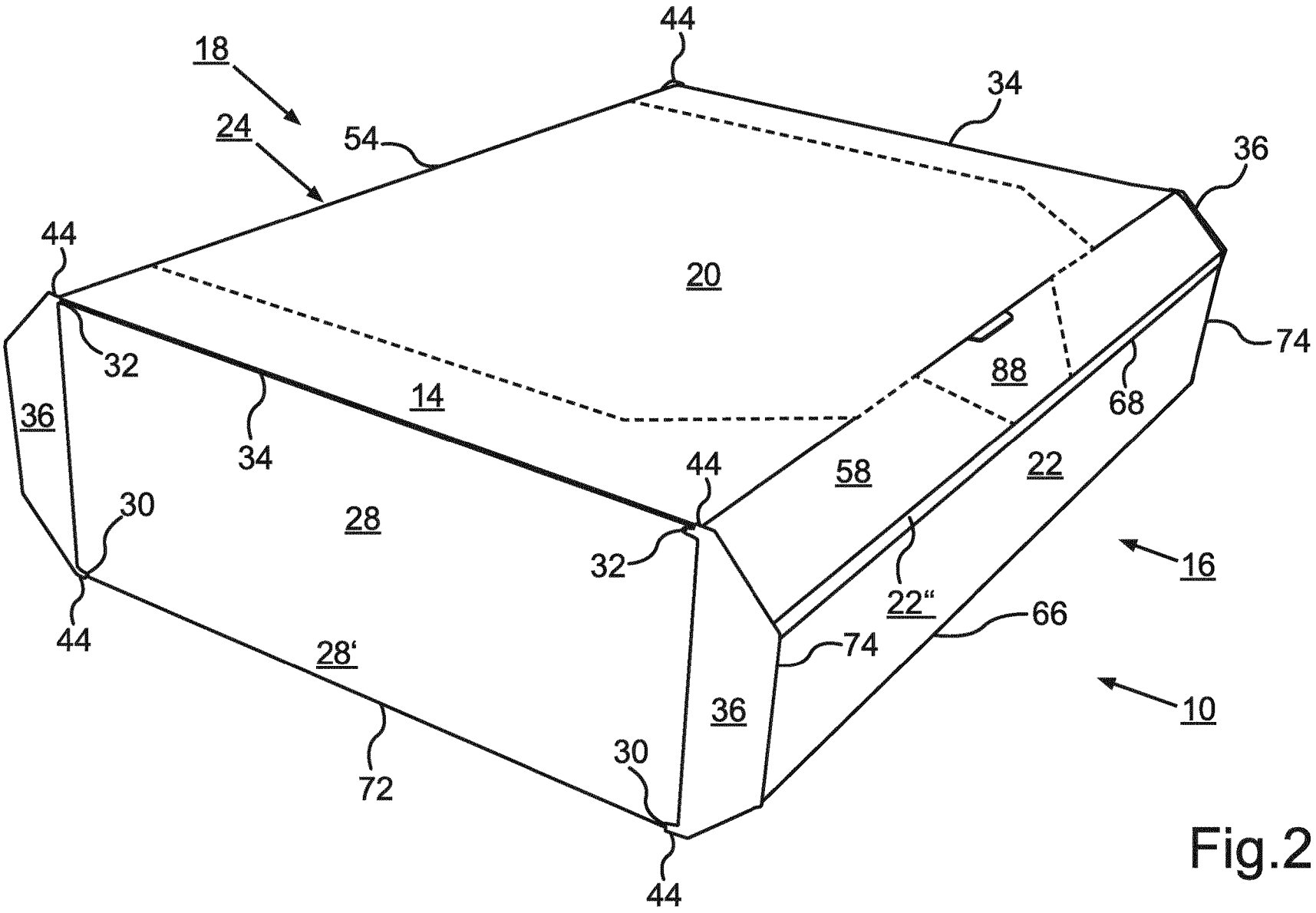
FIG. 2 shows a further schematic illustration of the packaging according to FIG. 1.

In addition, the packaging 10 has in each case one side flap 26, 28, which is articulated on the base wall and the top wall 12, 14 and is intended for closing the packaging 10 laterally (see also FIG. 2). The packaging 10 also comprises a total of four dust flaps 36, which are each articulated on the front walls 22, 24 via folding lines 74, 76. The dust flaps 36 serve to close the packaging 10 laterally in the region of the front and rear end sides 16, 18. Furthermore, the top wall 14 has a tear-open flap 20, which is delimited in the top wall 14 via corresponding perforation lines 46, 48. In the region of an adhesive-bonding flap 58, which is articulated on the top wall 14 via a folding line 52, the tear-open flap 20 merges into a grip flap 88, which is defined via perforation lines 84, 86 formed in the adhesive-bonding flap 58. For easier opening of the tear-open flap, a cut line 80 is formed adjacent to the folding line 52, and within the grip flap 88, and serves to form a pull tab 82. It can be seen that the pull tab 82 projects slightly beyond the outlines of the prismatic body of the packaging 10 and is thus easy to grip.

It can also be seen that the dust flaps 36 are designed such that, in the respective closed position, they rest, at least in part, on the front and rear walls 22', 22", 24', 24" on which it is not articulated, and project beyond the same at least in part. It is also the case that the dust flaps 36 comprise in each case two opposite latching noses 44, which, in the closed position, each latch in corresponding recesses 30, 32 formed in the side flaps 26, 28. The recesses 30 here are formed in a transition region between the base wall 12 and the respective side flap 26, 28. The recesses 32 are formed in the transition region between the top wall 14 and the corresponding side flaps 26, 28. It can be seen that the recesses 30 are formed at the respective ends of a folding line 70, and the recesses 32 are formed at the respective ends of a folding line 34. The folding line 70 here forms the transition between the base wall 12 and the side flap 26; the bending line 34 connects a first portion 26' of the side flap 26 to an insertion and/or adhesive-bonding flap 26" (see also FIG. 3). It can also be seen that the latching noses 44 also each project beyond the actual prismatic body of the packaging 10.

In the exemplary embodiment illustrated, the front end side 16 is formed by the front walls 22, 22', 22" (see also FIG. 3), which are connected to one another via corresponding folding lines 64, 66, 68. The front wall 22" here is connected to the adhesive-bonding flap 58. The rear end side 18 is formed by the rear walls 24, 24', 24", which are connected to the top wall 14 and the base wall 12 via corresponding folding lines 54, 62 (see also FIG. 3).

FIG. 2 shows a further schematic illustration of the packaging 10 according to FIG. 1. Evident once again is the overall octagonal configuration of the packaging 10, which lies horizontally on the base wall 12. It is clear that the dust flaps 36 are formed identically on four sides of the packaging. The dust flaps 36, once again, latch in the recesses 30, 32 by way of the latching noses 44. It can be seen that the side flap 28 has the corresponding recesses 30, 32, the latter being formed at the respective ends of the folding lines 72, 34. The folding line 72 here connects the base wall 12 to the side flap 28; the folding line 34 connects a first region 28" of the side flap 28 to a second region 28", which is designed in the form of an insertion and/or adhesive-bonding flap (see also FIG. 3). As far as the description of the rest of the features illustrated in FIG. 2 is concerned, reference is made to the description relating to FIG. 1.

Figure 3:
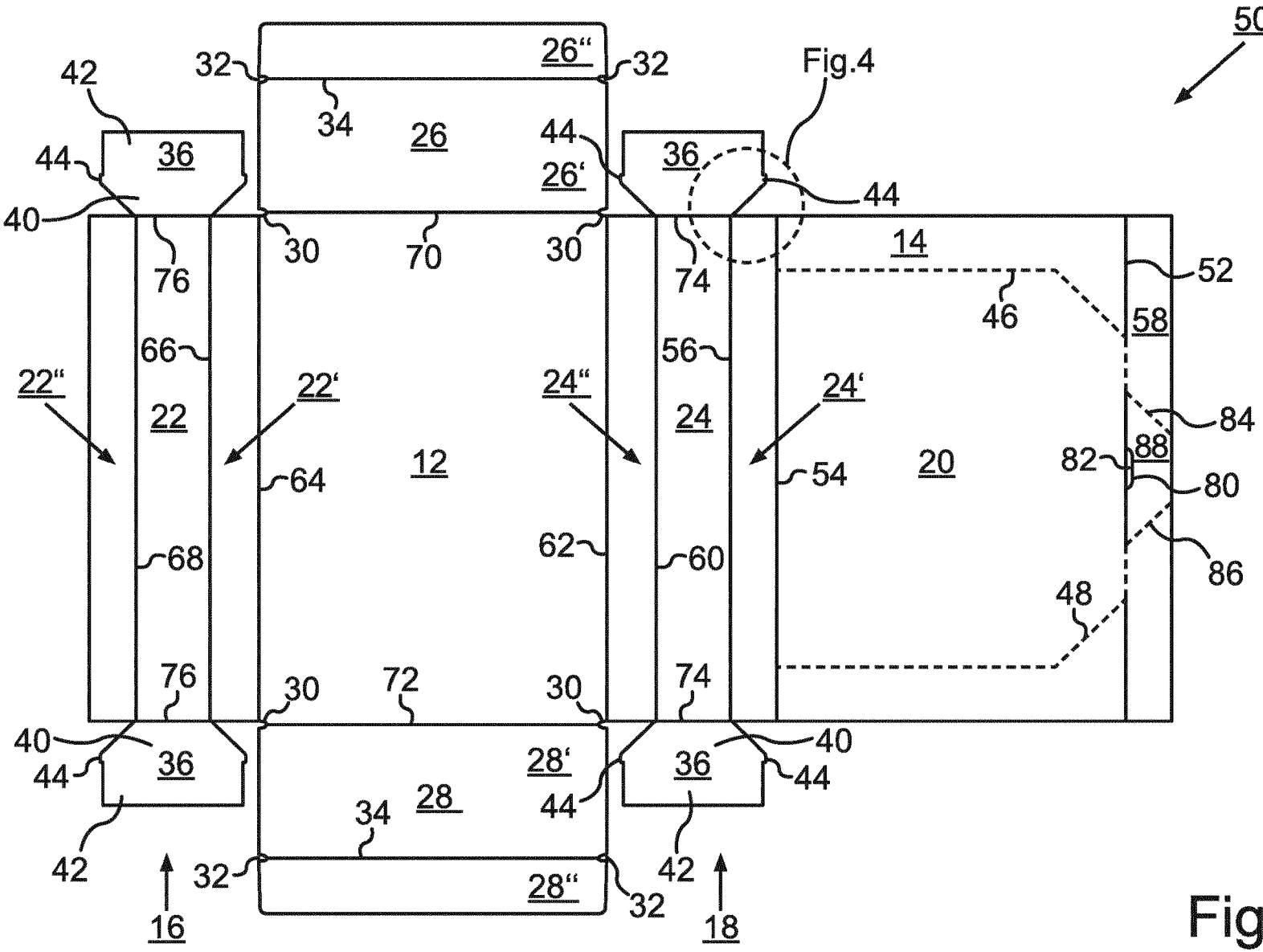
FIG. 3 shows a schematic illustration of a blank according to the invention for the packaging according to FIG. 1.

FIG. 3 shows a schematic illustration of a blank 50 of the packaging 10 according to FIG. 1 or FIG. 2. The blank 50 comprises base-wall, top-wall, front-wall and rear-wall elements 12, 14, 22, 22', 22", 24, 24', 24", which are connected via folding lines 52, 54, 56, 60, 62, 64, 66, 68 and are intended for forming the packaging 10 in the form of a prismatic body in the folded state of the blank 50 (see also FIGS. 1 and 2). It can be seen that the blank 50 comprises a respective dust flap 36, which is articulated at the ends of the front-wall element 22 and of the rear-wall element 24. The dust flaps are each articulated on the front-wall and rear-wall elements 22, 24 via corresponding folding lines 74, 76. In addition, an adhesive-bonding flap 58 is articulated on the top-wall element 14 via the folding line 52.

It can be seen that the dust flaps 36 comprise in each case two opposite latching noses 44, wherein the latching noses 44 are designed such that, in the folded state of the blank 50 and in the closed position of the dust flap 36, they butt against the front-wall and rear-wall elements 22', 22", 24', 24" and also sub-regions of the base-wall and of the top-wall elements 12, 14. In addition, it is clear that the length of the respective folding lines 74, 76 is smaller than the length and width of the respective dust flaps 36 in this region. This means that the respective dust flap 36 projects on either side beyond the articulation. The boundary lines of the respective first portions 40 of the dust flaps 36 here are designed to run at an angle of approximately 45°, or approximately 135°, starting from the respective folding line 74, 76 of the corresponding front-wall or rear-wall element 22, 24.

In addition, it is clear from FIG. 3 that the dust flaps 36 comprise a respective first portion 40, wherein the first portion 40 is articulated on the corresponding front-wall or rear-wall element 22, 24, and is designed such that, in the folded state of the blank 50 and in the closed position of the dust flap 36, it covers over that region of the cross-sectional surface 38 prismatic-body-design packaging 10 which is formed by the front-wall and rear-wall elements 22, 22', 22", 24, 24', 24", which are arranged on the end sides. In addition, in the exemplary embodiment illustrated, the dust flaps 36 have a second portion 42, which adjoins the first portion 40, wherein the second portion 42 is designed such that, in the folded state of the blank 50 and in the closed position of the dust flap 36, it butts against the inner sides of the base-wall and top-wall elements 12, 14. However, it is also possible for further latching noses to be formed in the first portion 40 and/or the second portion 42.

Furthermore, it is clear that the recesses 30, 32 are formed at the opposite ends of the respective folding lines 70, 72, 34. The folding line 34 here connects the first portion 26', 28' of the respective side flap 26, 28 to the corresponding second portion 26", 28" of the respective side flap 26, 28. The second portion 26", 28" here can be designed in the form of an insertion and/or adhesive-bonding flap.

In addition, the top-wall element 14 of the blank 50 has a tear-open flap 20, which is formed via the perforation lines 46, 48. In the region of the adhesive-bonding flap 58, the tear-open flap 20 is continued in a grip flap 88, which is formed via the perforation lines 84, 86. For easier opening of the tear-open flap 20, use is made of the pull tab 82, which is formed by means of the cut line 80.

Figure 4:
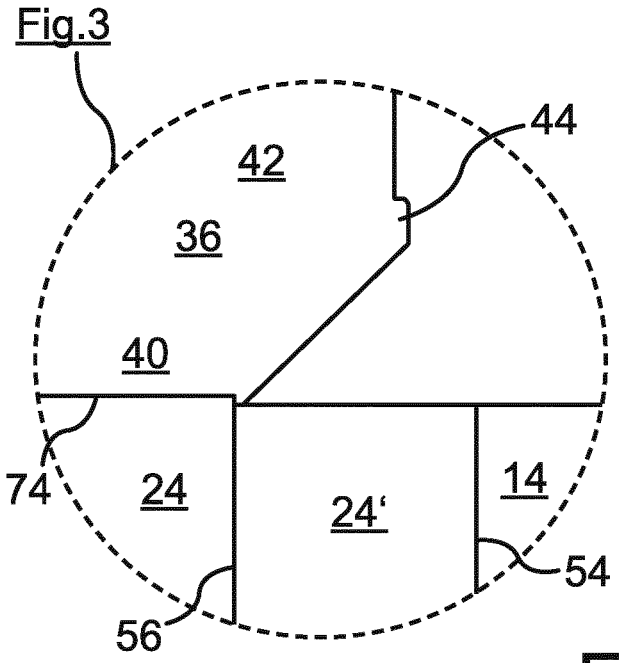
FIG. 4 shows a schematic illustration of a detail of the blank shown in FIG. 3.

FIG. 4 shows a schematic illustration of a detail of the blank 50 shown in FIG. 3. It can be seen that the dust flap 36 has its first portion 40 articulated on the front-wall element 22 via the folding line 74. The dust flap 36 here is designed to be wider and longer in this region than the folding line 74 and therefore projects into a region of the further front-wall element 22'. This results in something of an overhang of the dust flap 36 in this region, said overhang serving to project beyond the corresponding front-wall element 22' when the packaging 10 is in the joined-together state. The same applies to the opposite end (not illustrated) of the dust flap 36 and to all other dust flaps 36 of the blank 50. The design of all other dust flaps is identical to this.

Those exemplary embodiments of the packaging 10 and of the blanks 50 which are described in the figures above serve to clarify the basic principle of the present invention. In particular, a large number of differently designed packagings are conceivable. It is therefore possible for the cross-sectional surfaces 38 of the prismatic-body-design packaging 10 to be of not just octagonal design, but also of quadrilateral, pentagonal, hexagonal, heptagonal, nonagonal, decagonal, hendecagonal or dodecagonal design. However, other shapes, for example round shapes or combinations of round and polygonal shapes, are also possible.

The packagings described above are designed in the form of folding boxes. They, like the associated blanks, consist, in particular, of cardboard, paper, plastic or comparable materials.

The invention claimed is:

1. A packaging made of cardboard, paper or the like, comprising:

a base wall and a top wall, at least a respective front wall and a rear wall, which connect the base wall and the top wall and are intended for forming end sides of the packaging, wherein the packaging is configured in the form of a prismatic body along a longitudinal axis running parallel to the base wall and the top wall;

a side flap articulated on the base wall; and at least one dust flap, which is articulated at at least one end of at least one of the front wall and the rear wall, wherein the dust flap is configured such that, in a closed position, it rests, at least in part, at least on one of the, or on the, front walls and rear walls on which it is not articulated, and/or on the base wall and/or the top wall, and projects, at least in part, beyond the corresponding front walls or rear walls on which it is not articulated, and/or the base wall and/or the top wall, and wherein the dust flap includes a first latching nose, which, in the closed position, latches in a first recess formed at a first folding line of the side flap, and a second latching nose, which, in the closed position, latches in a second recess formed at a second folding line of the side flap.

2. The packaging as claimed in claim 1, wherein each of the first and second latching noses is configured designed such that, in the closed position of the dust flap, it butts against the side flap and at least one of the front walls or rear walls on which it is not articulated, and butts against the side flap and one of the base wall and the top wall.

3. The packaging as claimed in claim 2, wherein the dust flap comprises at least a first portion, wherein the first portion is articulated on the corresponding front wall and/or rear wall and is designed such that, in the closed position of the dust flap, it covers over that region of a cross-sectional surface of the prismatic-body-design packaging which is formed by the front and/or rear walls, which are arranged on the end sides and/or at the rear, wherein the cross-sectional surface is formed perpendicularly to the longitudinal axis.

4. The packaging as claimed in claim 3, wherein the dust flap comprises at least a second portion, which adjoins the first portion, wherein the second portion is designed such that, in the closed position of the dust flap, it butts against inner sides of the base wall and the top wall.

5. The packaging as claimed in claim 4, wherein the first and second latching noses are formed in the first portion and/or the second portion or in each case at least one the first and second latching noses is formed in the first portion and/or the second portion.

6. The packaging as claimed in claim 1, wherein the first recess is formed at the first folding line of the side flap in a transition region between the base wall and the side flap and the second recess is formed at the second folding line of the side flap in a transition region between the top wall and the side flap.

7. The packaging as claimed in claim 1, wherein at least one tear-open flap is formed within the top wall.

8. The packaging as claimed in claim 1, wherein a cross-sectional surface is of polygonal design, in particular quadrilateral, pentagonal, hexagonal, heptagonal, octagonal, nonagonal, decagonal or dodecagonal design, in a direction perpendicular to the longitudinal axis of the packaging of the prismatic-body-design packaging.

9. The packaging as claimed in claim 1, wherein the at least one dust flap comprises:

a first dust flap, which is articulated at a first end of the front wall, wherein the first dust flap is configured such that, in the closed position, it rests, at least in part, on the front walls on which it is not articulated, and on the base wall and the top wall, and projects, at least in part, beyond the corresponding front walls on which it is not articulated, and/or the base wall and/or the top wall, and wherein the first dust flap includes the first latching nose, which, in the closed position, latches in the first recess formed at a first end of the first folding line of the side flap, and the second latching nose, which, in the closed position, latches in the second recess formed at a first end of the second folding line of the side flap; and a second dust flap, which is articulated at a first end of the rear wall, wherein the second dust flap is configured such that, in the closed position, it rests, at least in part, on the rear walls on which it is not articulated, and on the base wall and the top wall, and projects, at least in part, beyond the corresponding rear walls on which it is not articulated, and/or the base wall and/or the top wall, and wherein the second dust flap includes a first latching nose, which, in the closed position, latches in a third recess formed at a second end of the first folding line of the side flap, and a second latching nose, which, in the closed position, latches in a fourth recess formed at a second end of the second folding line of the side flap.

10. The packaging as claimed in claim 9, wherein the at least one dust flap further comprises:

a third dust flap, which is articulated at a second end of the front wall, wherein the third dust flap is configured such that, in the closed position, it rests, at least in part, on the front walls on which it is not articulated, and on the base wall and the top wall, and projects, at least in part, beyond the corresponding front walls on which it is not articulated, and/or the base wall and/or the top wall, and wherein the third dust flap includes a first latching nose, which, in the closed position, latches in a first recess formed at a first end of a first folding line of a second side flap, and a second latching nose, which, in the closed position, latches in a second recess formed at a first end of a second folding line of the second side flap; and a fourth dust flap, which is articulated at a second end of the rear wall, wherein the fourth dust flap is configured such that, in the closed position, it rests, at least in part, on the rear walls on which it is not articulated, and on the base wall and the top wall, and projects, at least in part, beyond the corresponding rear walls on which it is not articulated, and/or the base wall and/or the top wall, and wherein the fourth dust flap includes a first latching nose, which, in the closed position, latches in a third recess formed at a second end of the first folding line of the second side flap, and a second latching nose, which, in the closed position, latches in a fourth recess formed at a second end of the second folding line of the second side flap.

11. A blank for producing a packaging made of cardboard, paper or the like, comprising:

base-wall, top-wall, side flap, front-wall and rear-wall elements, which are connected via folding lines and are intended for forming the packaging in the form of a prismatic body in a folded state of the blank, wherein the blank comprises at least one dust flap, which is articulated at at least one end of at least one front-wall and/or rear-wall element, wherein the dust flap is configured such that, in the folded state of the blank and in a closed position, it rests, at least in part, at least on one of the, or on the, front-wall and rear-wall elements on which it is not articulated and/or on the base-wall element and/or top-wall element, and projects, at least in part, beyond the corresponding front-wall elements or rear-wall elements on which it is not articulated, and/or the base-wall element and/or the top-wall element, and wherein the dust flap includes a first latching nose, which, in the closed position, latches in a first recess formed at a first folding line of a first side flap element, and a second latching nose, which, in the closed position, latches in a second recess formed at a second folding line of the first side flap element.

12. The blank as claimed in claim 11, wherein each of the first and second latching noses is configured designed such that, in the folded state of the blank and in the closed position of the dust flap, it butts against the first side flap element and at least one of the front-wall elements or rear-wall elements on which it is not articulated, and butts against the first side flap element and one of the base-wall element and the top-wall element.

13. The blank as claimed in claim 11, wherein the first recess is formed at the first folding line of the first side flap element in a transition region between the base-wall element and the first side flap element, and the second recess is formed at the second folding line of the first side flap element in a transition region between the top-wall element and the first side flap element.

14. The blank as claimed in claim 13, wherein the dust flap comprises at least a first portion, wherein the first portion is articulated on the corresponding front-wall element and/or rear-wall element and is designed such that, in the folded state of the blank and in the closed position of the dust flap, it covers over that region of a cross-sectional surface of the prismatic-body-design packaging which is formed by the front-wall and/or rear-wall elements, which are arranged on the end sides, wherein the cross-sectional surface is formed perpendicular to the longitudinal axis, and/or the dust flap comprises at least a second portion, which adjoins the first portion, wherein the second portion is designed such that, in the folded state of the blank and in the closed position of the dust flap, it butts against inner sides of the base-wall and top-wall elements.

15. The blank as claimed in claim 14, wherein the first and second latching noses are formed in the first portion and/or the second portion or in each case at least one of the first and second latching noses is formed in the first portion and/or the second portion.

* * * * *